US008082957B2

(12) United States Patent
Yuyama et al.

(10) Patent No.: US 8,082,957 B2
(45) Date of Patent: Dec. 27, 2011

(54) TABLET STORAGE AND TAKE-OUT APPARATUS

(75) Inventors: Shoji Yuyama, Toyonaka (JP); Katsunori Yoshina, Toyonaka (JP); Takafumi Imai, Toyonaka (JP); Masahito Miyashita, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 1473 days.

(21) Appl. No.: 10/587,486

(22) PCT Filed: Jan. 20, 2005

(86) PCT No.: PCT/JP2005/000652

§ 371 (c)(1),
(2), (4) Date: Sep. 14, 2006

(87) PCT Pub. No.: WO2005/072678

PCT Pub. Date: Aug. 11, 2005

(65) Prior Publication Data

US 2007/0163133 A1 Jul. 19, 2007

(30) Foreign Application Priority Data

Jan. 30, 2004 (JP) ..... 2004-024868

(51) Int. Cl.
*B65B 43/42* (2006.01)

(52) U.S. Cl. ..... 141/175; 141/165; 141/168; 141/177; 414/741; 221/219; 198/596

(58) Field of Classification Search ..... 141/129, 141/130, 165, 168, 175, 177; 53/475, 501, 53/505; 414/730, 741; 700/231–245; 221/219; 198/468.3, 596, 867.02, 803.7
See application file for complete search history.

(56) References Cited

U.S. PATENT DOCUMENTS

| | | | | |
|---|---|---|---|---|
| 4,596,107 | A * | 6/1986 | Pfleger, Sr. | 53/53 |
| 5,363,885 | A * | 11/1994 | McConnell et al. | 141/1 |
| 5,479,969 | A * | 1/1996 | Hardie et al. | 141/130 |
| 6,006,946 | A * | 12/1999 | Williams et al. | 221/9 |
| 6,119,737 | A | 9/2000 | Yuyama et al. | |
| 6,308,109 | B1 | 10/2001 | Yuyama et al. | |
| 6,385,943 | B2 * | 5/2002 | Yuyama et al. | 53/131.4 |
| 6,421,584 | B1 * | 7/2002 | Norberg et al. | 700/242 |
| 6,449,927 | B2 * | 9/2002 | Hebron et al. | 53/501 |
| 6,604,903 | B2 * | 8/2003 | Osborne et al. | 414/411 |
| 6,905,046 | B2 * | 6/2005 | Coughlin et al. | 221/219 |
| 7,530,211 | B2 * | 5/2009 | McErlean et al. | 53/505 |
| 7,853,355 | B1 * | 12/2010 | Willemse et al. | 700/243 |

FOREIGN PATENT DOCUMENTS

| | | |
|---|---|---|
| JP | 6-42954 | 6/1994 |
| JP | 7-76418 | 3/1995 |
| JP | 7-37992 | 4/1995 |
| JP | 11-70901 | 3/1999 |
| JP | 0 999 129 | 5/2000 |
| JP | 2002-347931 | 12/2002 |

* cited by examiner

*Primary Examiner* — Timothy L Maust
(74) *Attorney, Agent, or Firm* — Wenderoth, Lind & Ponack, LLP

(57) ABSTRACT

A device (1) for containing and dispensing tablets, wherein vial bottles (3) filled with tablets wait in waiting spaces (701*a, b, c*) and the vial bottles (3) are taken out from the waiting spaces (701*a, b, c*). A plurality of pairs of holding members (703*a, b*) facing each other for holding the bodies of the vial bottles (3) are installed in the waiting spaces (701*a, b, c*). Also, stock sensors (710) in the same quantity as the pair of holding members (703*a, b*) are installed to check for each pair of holding members whether a vial bottle is held on the pair of holding members (703*a, b*) or not.

11 Claims, 11 Drawing Sheets

TABLET STORAGE AND TAKE-OUT APPARATUS

BACKGROUND OF THE INVENTION

1. Technical Field

The present invention relates to a tablet storage and take-out apparatus which contains various kinds of tablets and which fills a vial with tablets necessary to a patient and stores the vial in a storage part so that the vial can be taken out from the storage part.

2. Description of the Related Art

A conventional tablet storage and take-out apparatus, as described in Japanese Patent Application Laid-open No. H11-70901, can store vials one by one in a plurality of storage chambers provided in a storage part. The storage part described in Japanese Patent Application Laid-open No. H11-70901 is provided with a pair of holding members which is movable in a horizontal direction perpendicular to a vial take-out direction so as to pinch and hold the vial filled with tablets. It is also disclosed that the storage part is also provided with a sensor for monitoring a space between the pair of holding members in which the vial is held.

However, in the case that a plurality of vials is dispensed per one patient, an operator needs to take-out the vials from the plurality of storage chambers, which increases the risk of forgetting to take-out one or more of the vials. In addition, in the case that the vials of other patient are taken out subsequently, there is also a risk of mistaking the vials. A direction that the vial is inserted between the pair of holding members and a direction that the vial is taken out from the pair of holding members are perpendicular to a direction that the pair of holding members moves. If the pair of holding members is biased hard so as to hold the vial firmly, there has been a disadvantage that the vial cannot be taken out without pulling it out forcibly.

SUMMARY OF THE INVENTION

1. Problems to be Solved by the Invention

Thus, it is an object of the invention to provide a tablet storage and take-out apparatus capable of surely and easily taking out vials that are filled with a plurality of tablets necessary for one patient without forgetting and mistake.

2. Means for Solving the Problems

According to the present invention, a tablet storage and take-out apparatus in which a vial filled with tablets is waiting at a waiting space for being taken out, comprises plural pairs of holding members for holding a barrel of the vial. The plural pairs of holding members are provided at the waiting space so as to be opposed to each other. The apparatus also includes stock sensors for detecting whether the vial is held by the plural pairs of holding members or not, the stock sensor being provided so as to correspond to the plural pairs of holding members. In principal, the pair of holding members holds one vial.

In the tablet storage and take-out apparatus according to the present invention, the plural pairs of holding members may be provided with concave portions that are opposed to each other. The plural pairs of holding members are supported so as to pivot around two shafts that are positioned away from each other by a distance larger than the diameter of the vial so that the concave portions can come close to and move away from each other. The plural pairs of holding members are urged so that the concave portions can come close to each other and are stable at a state in which the concave portions come closest to each other. Also, the concave portions can pinch and hold the barrel of the vial so that the center of the vial is positioned between the concave portions. The shape of the concave portions may be a V-shape or a circular arc shape (preferably, a circular arc shape identical or closer to the outer periphery of the vial).

In the tablet storage and take-out apparatus according to the present invention, the stock sensors may be sensors for detecting whether the plural pairs of holding members hold the vial or not by detecting that the plural pairs of holding members are situated at a position close to each other where the plural pairs of holding members do not hold the vial or a position away from each other where the plural pairs of holding members hold the vial.

In the tablet storage and take-out apparatus according to the present invention, the plural pairs of holding members may be juxtaposed in a line in a depth direction from the take-out side of the waiting space.

In the tablet storage and take-out apparatus according to the present invention, the plural pairs of holding members positioned at the take-out side may have a high priority; if none of the plural pairs of holding members hold a vial, the pair of holding members having higher priority holds the vial newly filled with tablets; and if any one of the plural pairs of holding members hold a vial, the pair of holding members having a priority next lower than the pair of holding members having a priority lowest among the pairs of holding members holding the vial holds the subsequent vial.

In the tablet storage and take-out apparatus according to the present invention, the waiting space may have plural spaces. The plural pairs of holding members in the same space hold the plural vials filled with tablets for the same patient; and the plural pairs of holding members in a different space hold the vial filled with tablets for a different patient. That is to say, the waiting space is divided into spaces for holding the vials for every patient.

3. Effect of the Invention

In the tablet storage and take-out apparatus of the present invention having the above construction, as the plural pairs of holding members are provided in one waiting space, the plurality of vials filled with tablets necessary for one patient can be collected in one waiting space. Thus, it is possible to prevent forgetting and other mistakes associated with the process of removing the vials.

In the tablet storage and take-out apparatus of the present invention, when pushing the vials between the holding members or when taking the vial from the holding members, forces can be applied to pivot the holding members in directions where the distance of the holding members is extended. Thus, the vial can be easily pinched in and taken from the space between the concave portions.

In the tablet storage and take-out apparatus of the present invention, the stock sensor detects the existence or nonexistence of the vial not directly but indirectly based on the position of the holding members. Thus, even if the vial is held in a tilted state, it is possible to detect that the vial is held, thereby preventing an error in detection and enhancing reliability.

In the tablet storage and take-out apparatus of the present invention, as the plural pairs of holding members are juxtaposed in a line in a depth direction from the take-out side of the waiting space, an occupation area of the waiting space becomes small, enabling to provide many waiting spaces.

In the tablet storage and take-out apparatus of the present invention, the filled vial is held by the holding members in the order from the take-out side, and thus, an operator can easily take-out the vial. When the operator tries to take-out the vial that has already been conveyed to the waiting space before completing the transfer of the vials to the waiting space, the new vial is held on the holding member behind the holding members that have already held the vial. Therefore, the operator never touches by mistake a member for transferring the vial.

In the tablet storage and take-out apparatus of the present invention, as the waiting space is divided into spaces for holding the vials for every patient, forgetting and mistake associated with removing the vial are not caused even if the operator continuously takes out the vials for a plurality of patients.

As described above, in the tablet storage and take-out apparatus according to the present invention, the vials filled with a plurality of tablets necessary for one patient can be stored together in one storage chamber, thereby preventing forgetting and mistakes associated with taking out the vial. In addition, a large force is not necessary for taking out the vial.

PREFERRED EMBODIMENTS OF THE INVENTION

Figure 1:
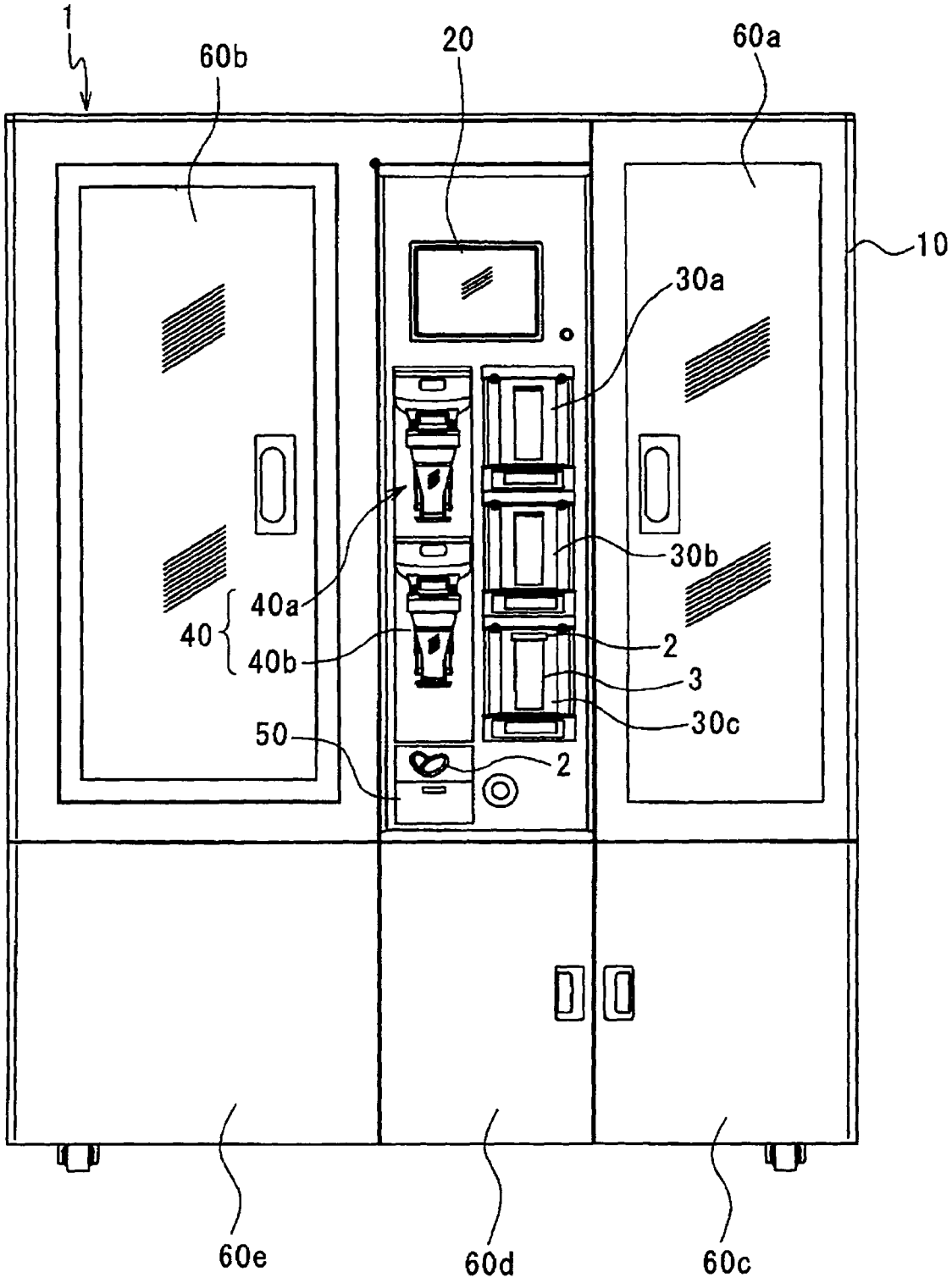
FIG. 1 is an elevation view of a tablet storage and take-out apparatus according to the present invention.
Figure 2:
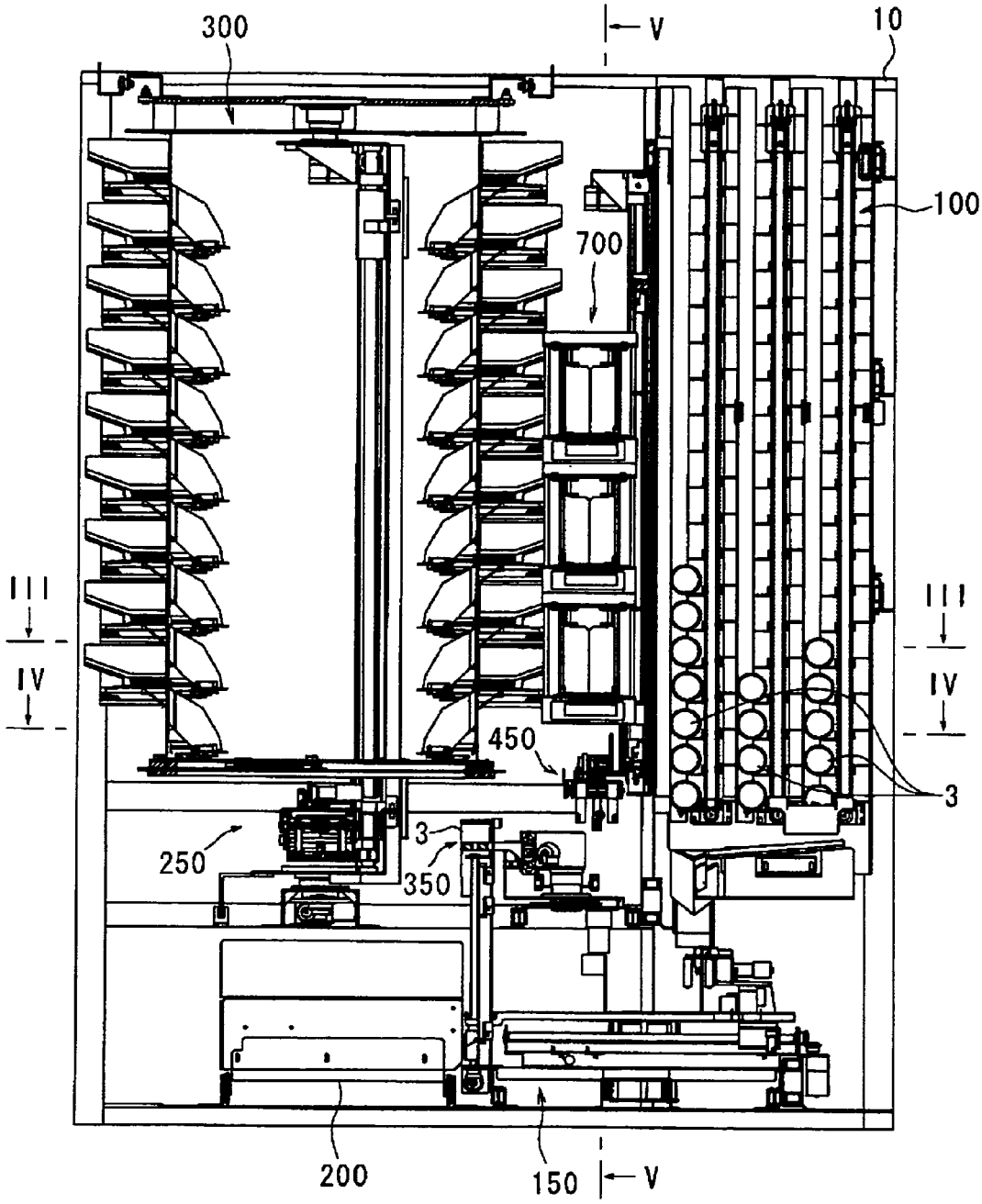
FIG. 2 is an elevation view of the interior of the tablet storage and take-out apparatus of FIG. 1.
Figure 3:
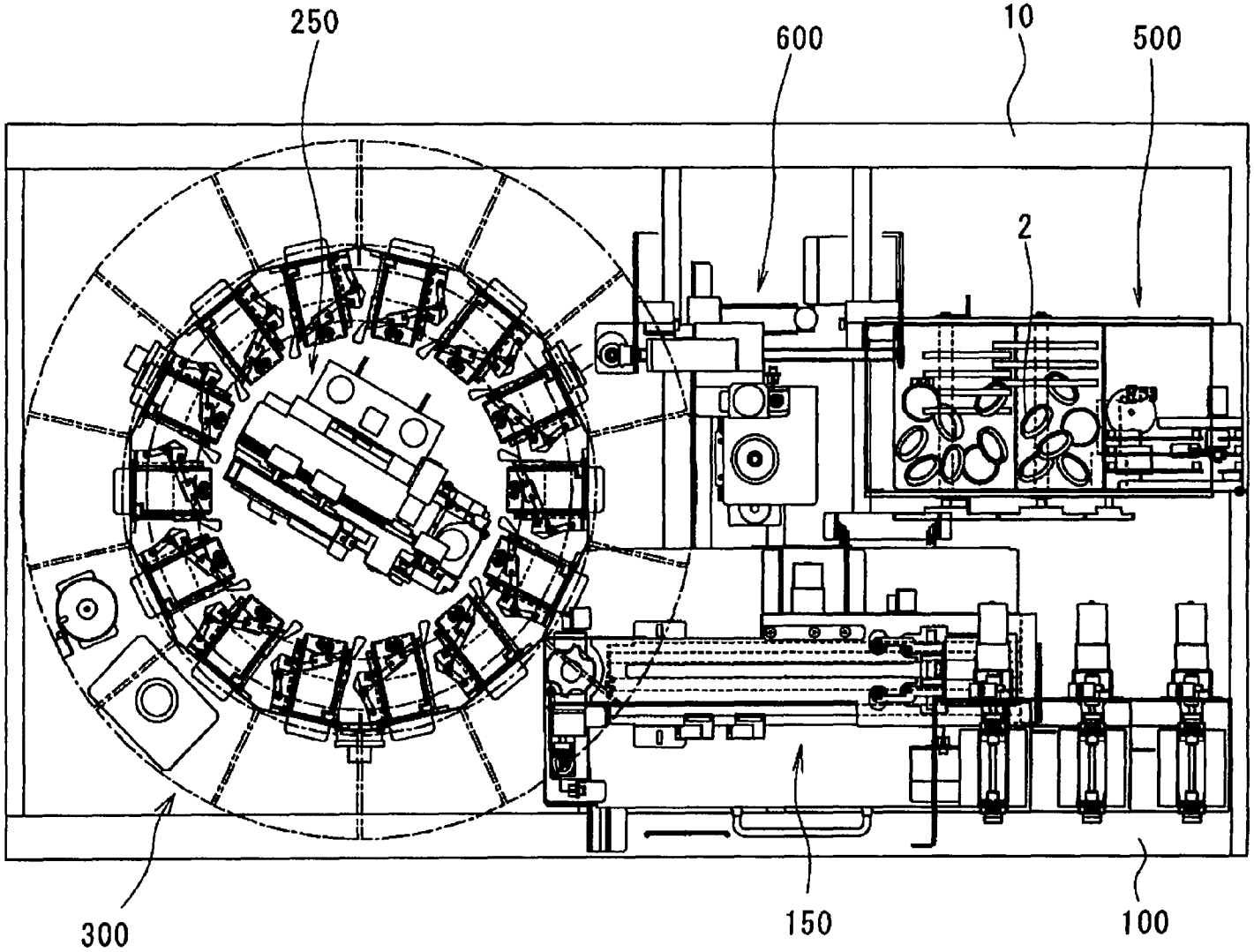
FIG. 3 is a cross sectional view taken on line III-III of FIG. 2.
Figure 4:
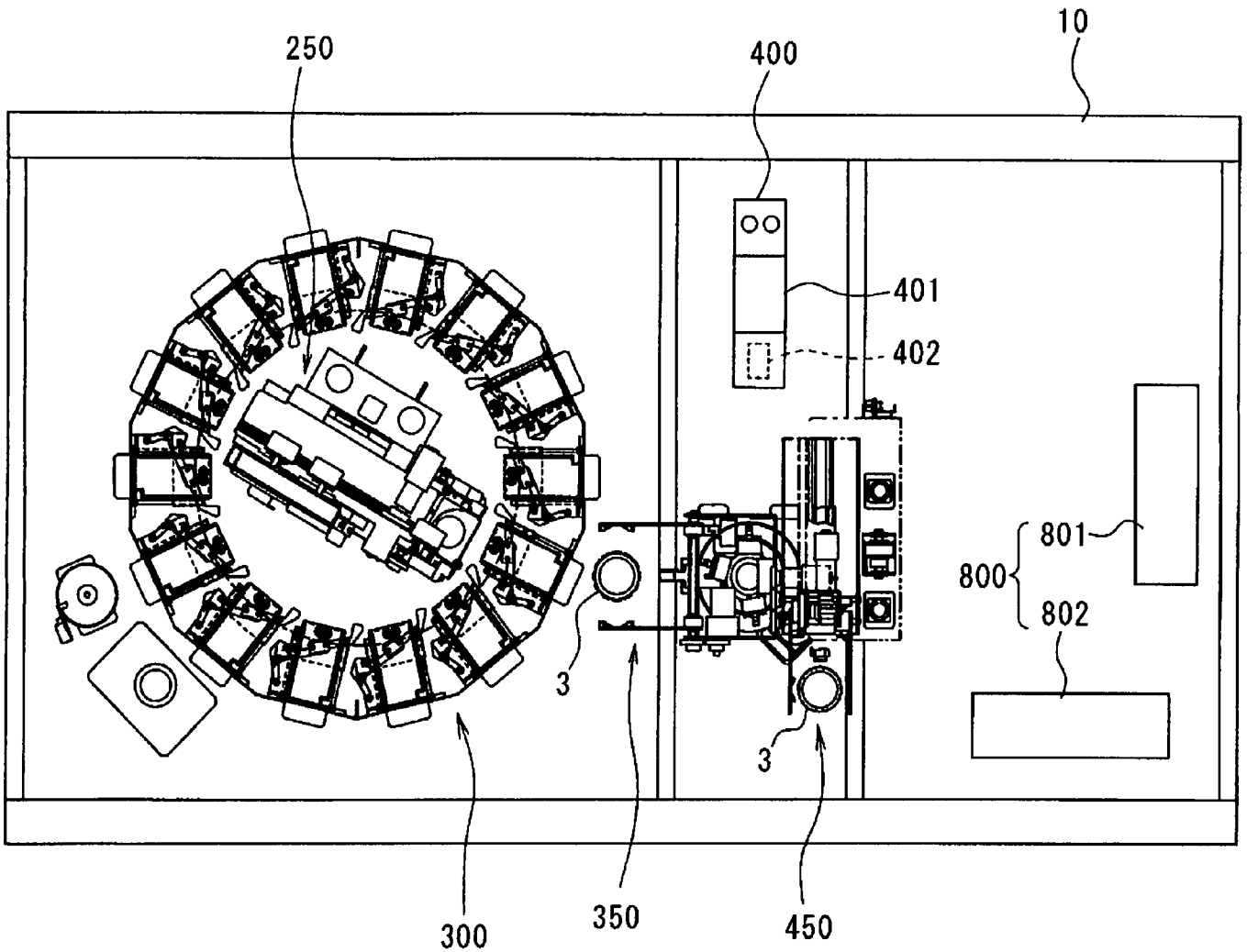
FIG. 4 is a cross sectional view taken on line IV-IV of FIG. 2.
Figure 5:
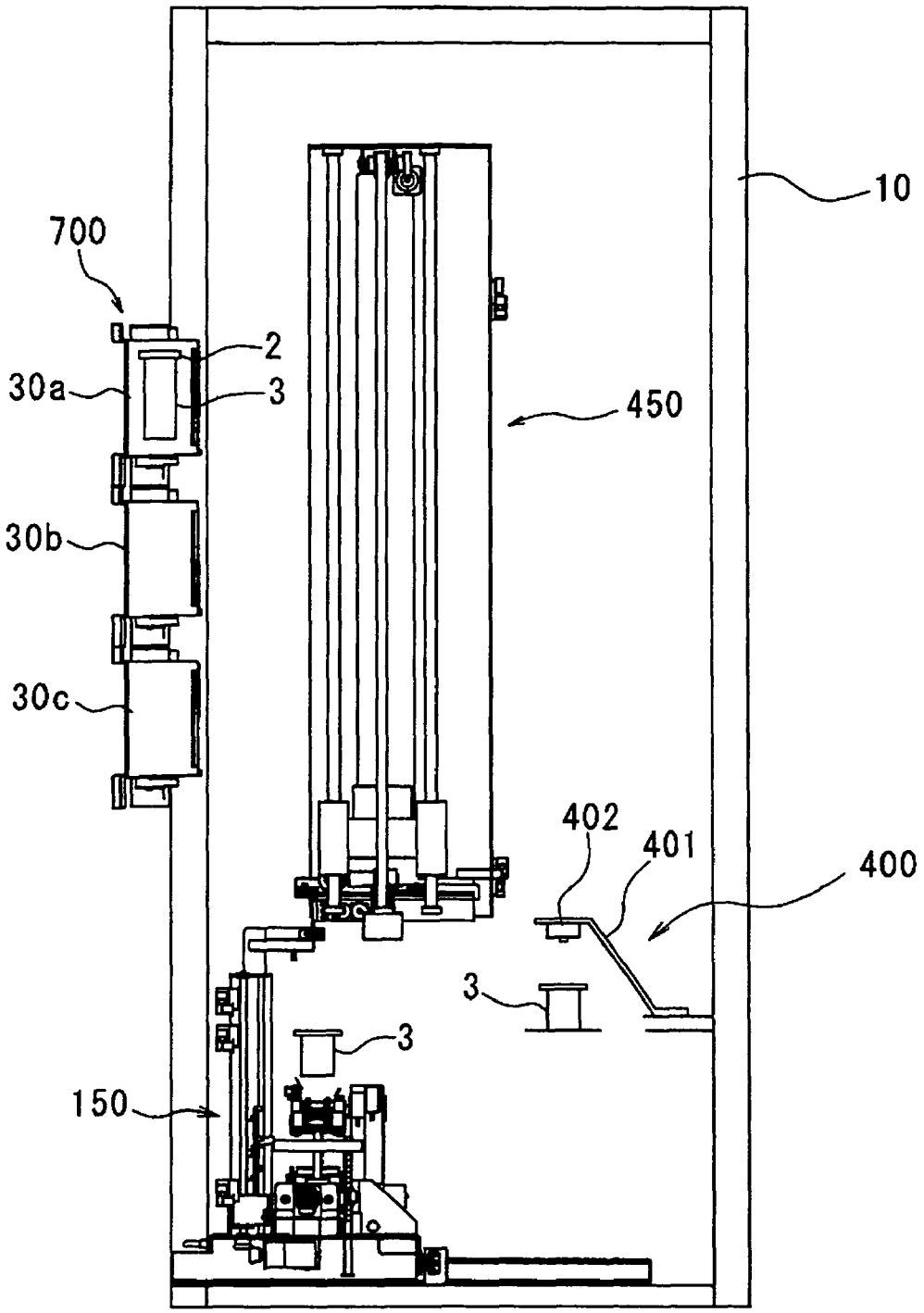
FIG. 5 is a cross sectional view taken on line V-V of FIG. 2.

FIG. 1 is an elevation view of a tablet storage and take-out apparatus 1 according to the invention. FIG. 2 is an elevation view of the interior of the tablet storage and take-out apparatus 1. FIG. 3 is a cross sectional view taken on line III-III of FIG. 2. FIG. 4 is a cross sectional view taken on line IV-IV of FIG. 2. FIG. 5 is a cross sectional view taken on line V-V of FIG. 2.

1. Overall Arrangement and Construction

First, a description will be given on the overall arrangement and construction of the tablet storage and take-out apparatus 1. As shown in FIG. 1, at the upper center of a main body 10 as viewed from the front, an operation display panel 20 is provided which provides displays required for operating the tablet storage and take-out apparatus 1. To the lower right of the operation display panel 20, three vial take-out ports 30*a*, 30*b*, and 30*c* are provided. To the lower left thereof are provided auxiliary tablet supply parts 40 (40*a*, 40*b*), under which an auxiliary cap storage part 50 is provided. The auxiliary tablet supply parts 40 store two different kinds of pyrazolone tablets respectively, and supply tablets in accordance with prescription data. The auxiliary cap storage part 50 randomly stores a large number of caps 2 and permits them to be manually taken out when necessary. At the upper right side of the tablet storage and take-out apparatus 1 as viewed from the front is provided a door 60*a* for replacing a vial 3. At the left side thereof is provided a door 60*b* for replacing and refilling tablets. At the bottom thereof are also provided doors 60*c*, 60*d*, and 60*e* for maintenance.

Inside the tablet storage and take-out apparatus 1, as shown in FIGS. 2, 3, 4, and 5, there are provided: a vial supply part 100, a labeling part 200, a tablet supply part 300, a photographing part 400, a cap supply part 500, a capping part 600, and a storage part 700. The vial supply part 100 is provided on the right side of the main body 10 as viewed from the front, as shown in FIG. 2, and stores a large number of vials 3 by size and supplies, one by one, vials 3 of a size suitable for receiving tablets in accordance with prescription data. The labeling part 200 is provided at the lower center of the main body 10 as viewed from the front, and puts a label with printed prescription information on a vial 3 supplied from the vial supply part 100. The tablet supply part 300 is provided on the left side of the main body 10, and stores a large number of tablets (non-pyrazolone) by type and supplies the tablets in accordance with prescription data. The photographing part 400 is provided, as shown in FIG. 4, on the center back side of the main body 10, and photographs a vial 3 from above for audit of tablets filled into the vial 3. The cap supply part 500 is provided, as shown in FIG. 3, on the right side of the main body 10 and behind the vial supply part 100, and stores caps 2 for plugging the vials 3, and supplies the caps one by one. The capping part 600 is provided on the center back side of the main body 10, and plugs a vial 3, which is filled with tablets, with a cap 2 supplied from the cap supply part 500. The storage part 700, as shown in FIG. 5, stores vials 3 filled with tablets and plugged with a cap 2 so that they can be taken out by an operator through take-out ports 30*a*, 30*b*, and 30*c*.

The tablet storage and take-out apparatus 1 is further provided, as shown in FIG. 2, with a first transfer robot 150, a second transfer robot 250, a third transfer robot 350, and a fourth transfer robot 450. The first transfer robot 150 is provided below the vial supply part 100, and can hold a vial 3 supplied from the vial supply part 100, transfer it leftward from the vial supply part 100 to the labeling part 200 in the horizontal direction of the main body, and transfer it upward from the labeling part 200 to the second transfer robot 250 or the third transfer robot 350. The second transfer robot 250 is provided inside the tablet supply part 300, and can hold a vial 3 delivered from the first transfer robot 150, transfer it to supply ports of the tablet supply part 300, and transfer it from the supply ports to the third transfer robot 350. The third transfer robot 350 is provided above the first transfer robot 150 in the main body 10, and can deliver, between the capping part 600 and the fourth transfer robot 450, a vial 3 delivered from the first transfer robot 150 or the second transfer robot 250. The fourth transfer robot 450 is provided above the third transfer robot 350, and can transfer a vial 3 delivered form the third transfer robot 350 upward to the storage part 700.

Figure 6:
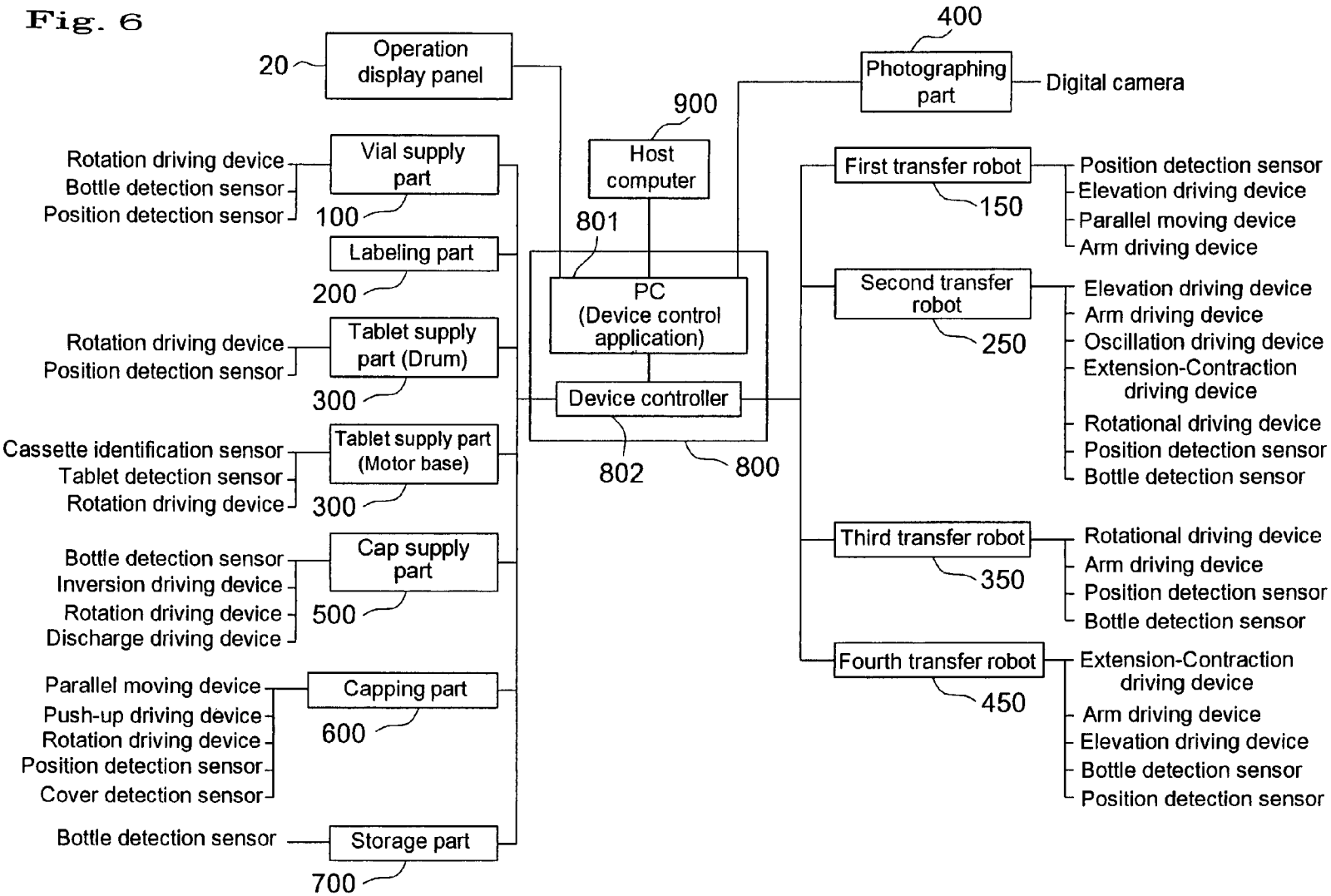
FIG. 6 is a block diagram of control performed by a control part.

In the tablet storage and take-out apparatus 1, as shown in FIG. 4, a control part 800 is provided on the right side of the main body 10. The control part 800 is, as shown in FIG. 6, composed of: a personal computer (PC) 801 in which apparatus control applications are installed; and a device controller 802 composed of a micro computer and the like. The PC 801 is connected to a host computer 900 installed in a hospital or a drug store, and receives inputted data such as prescription data and the like. The PC 801 is also connected to the operation display panel 20, and outputs display information required for the operation of the tablet storage and take-out apparatus 1 and also receives operation information inputted through the touch panel on the operation display panel 20. Furthermore, the PC 801 is connected to a digital camera provided in the photographing part 400. The device controller 802 is connected to sensors and driving devices of the vial supply part 100, the labeling part 200, the tablet supply part 300, the cap supply part 500, the capping part 600, and the storage part 700 so as to drive and control these parts. Moreover, the device controller 802 is connected to sensors and driving devices of the first transfer robot 150, the second transfer robot 250, the third transfer robot 350, and the fourth transfer robot 450 so as to drive and control these parts.

2. Fourth Transfer Robot and Storage Part

Hereinafter, a detailed description will be given on the fourth transfer robot 450 and the storage part 700 of the tablet storage and take-out apparatus 1 provided with the overall arrangement and construction as described above. The other parts are not related to the present invention, and thus are omitted from the description.

Figure 7:
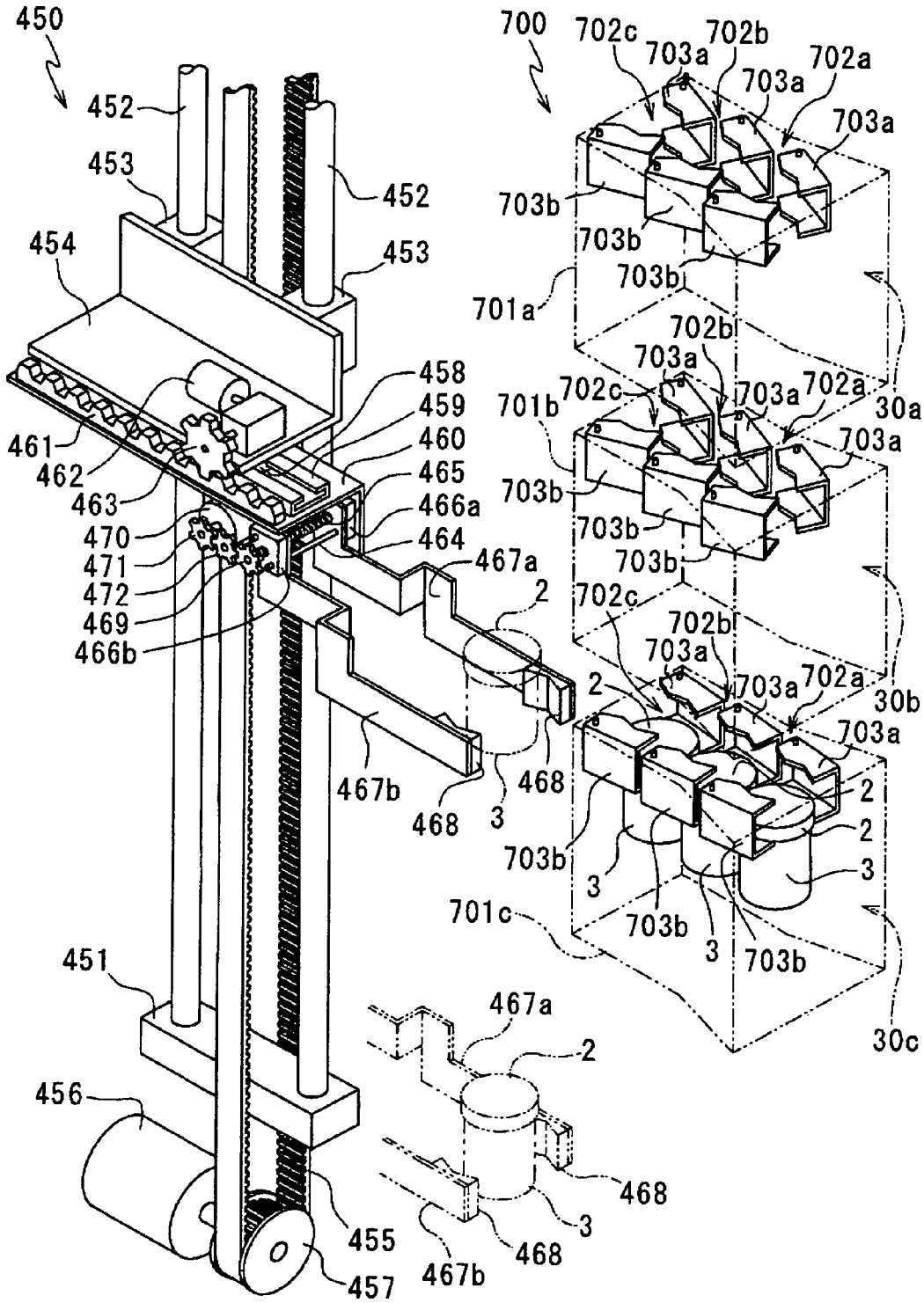
FIG. 7 is a perspective view of the fourth transfer robot of the tablet storage and take-out apparatus of FIG. 1.

As shown in FIG. 7, the fourth transfer robot 450 has a base plate 454 attached to two slide bearings 453 which are slidable along two parallel slide shafts 452. The slide shafts 452 are vertically mounted on shaft holders 451 fixed to the inside of the tablet storage and take-out apparatus 1. The base plate 454 is fixed on a timing belt 455 driven by a pulley 457 of a driving motor 456 so that the base plate goes up and down. A boom plate 460 is suspended from the base plate 454 by a carriage 459 that is slidably attached on a rail 458 provided on the lower surface of the base plate 454. The boom plate 460 has a rack 461 provided on the upper surface and is movable along the rail 458 in the horizontal direction by rotation of a pinion 463 driven by a driving, motor 462 provided on the base plate 454. The boom plate 460 has guide shafts 464 provided in a direction perpendicular to the slide shafts 453 and the rail 458, a feed screw 465 parallel to the guide shafts 464, and a pair of nuts 466*a*, 466*b* which engage with the feed screw 465. The feed screw 465 has two screw portions with reverse screw direction on both sides of the middle point. The two nuts 466*a*, 466*b* which engage with the feed screw 465 have also a reverse screw direction. From the nuts 466*a*, 466*b*, a pair of transfer arms 467*a*, 467*b* is extended in a direction of the rail 458. On opposite surfaces of the distal end of the transfer arms 467*a*, 467*b*, grip rubbers 468 are attached. The feed screw 465 has a driven gear 469 fixed on one end which is connected through an intermediate gear 472 to a drive gear 471 fixed on a grip motor 470 mounted on the boom plate 460.

Figure 8:
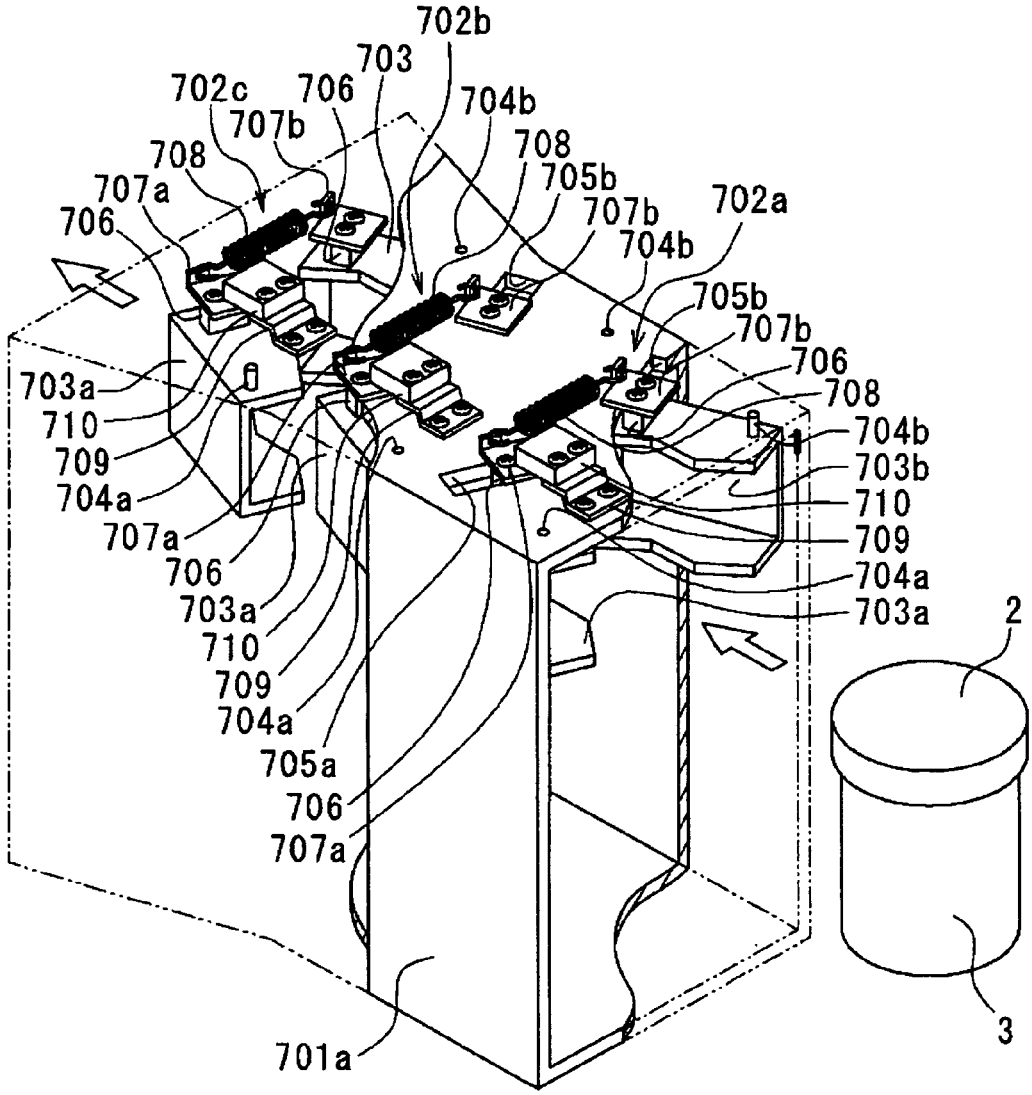
FIG. 8 is a perspective view of the storage chamber of the tablet storage and take-out apparatus of FIG. 1.

The storage part 700 has three storage chambers 701*a*, 701*b*, 701*c* juxtaposed vertically. The inner space of each of the storage chambers is a waiting space for temporarily storing the vial 3 filled with the tablets so that the operator can take-out the vial 3. The front openings of the storage chambers 701*a*, 701*b*, 701*c* are taking-out openings 30*a*, 30*b*, 30*c*. Each of the storage chambers 701*a*, 701*b*, 701*c* has three holding portions 702*a*, 702*b*, 702*c* which are juxtaposed at regular intervals in a line in a horizontal depth direction from the take-out side, i.e., the taking-out openings 30*a*, 30*b*, 30*c* to the depth side. The holding portions 702*a*, 702*b*, 702*c* have respectively three pairs of holding members 703*a*, 703*b* opposed to each other. The left and right holding members 703*a*, 703*b* are symmetric with respect to each other and have a C-character shape formed by two horizontal plates connected to one vertical plate. As the storage chambers 701*a*, 701*b*, 701*c* have same construction, only 701*a* is shown in FIG. 8 to explain further detailed structure thereof. The holding members 703*a*, 703*b* are mounted on the storage chamber 701*a* via pins 704*a*, 704*b* at one end opposite to the take-out opening 30*a* and closer to the fourth transfer robot 450 so as to pivot horizontally. The distance between the pins 704*a* and 704*b* is larger than the diameter of the vial 3 so that the vial 3 can be inserted between the holding members 703*a*, 703*b*. On the upper surface of the end of the holding members 703*a*, 703*b* opposite to the end attached with the pins 704*a*, 704*b*, spring metal pieces 707*a*, 707*b* are attached by means of screws via spacers 706 which pass through openings 705*a*, 705*b* formed in the upper wall of the storage chamber 701*a* so that the spring metal pieces 707*a*, 707*b* are positioned above the storage chamber 701*a*. Both ends of spring 708 are connected to the metal pieces 707*a*, 707*b*, allowing the holding members 703*a*, 703*b* to be biased so that the ends which are not attached with pins 704*a*, 704*b* are attracted to each other. On the upper surface of the storage chamber 701*a*, sensor metal pieces 709 are attached by means of screws at portions corresponding to the holding portions 702*a*, 702*b*, 702*c*. On the sensor metal pieces 709, stock sensors 710 are attached by means of screws so as to be situated above the spring metal pieces 707*a*.

Figure 9:
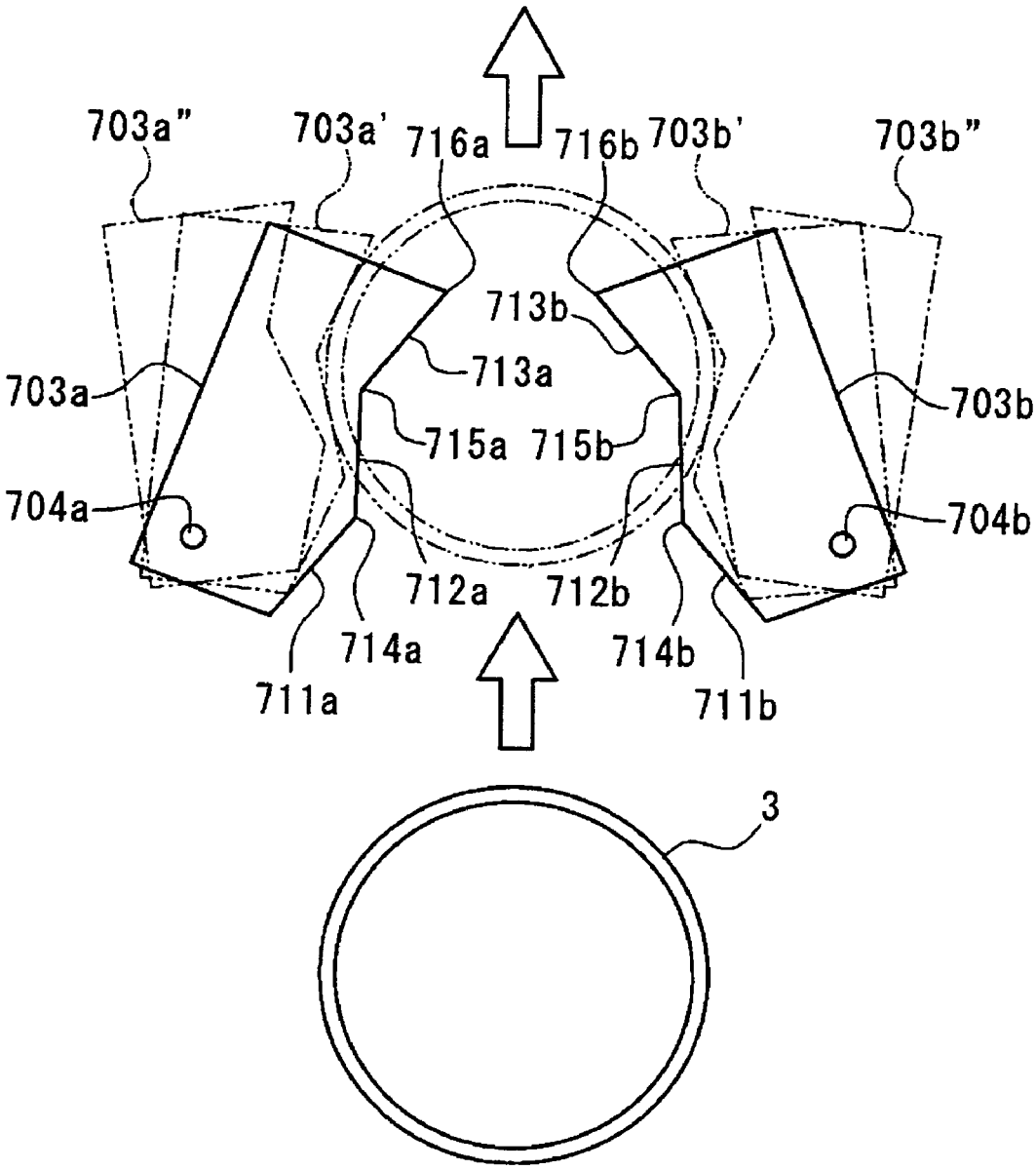
FIG. 9 is a plan view of the holding members in the storage chamber of FIG. 8.
Figure 10:
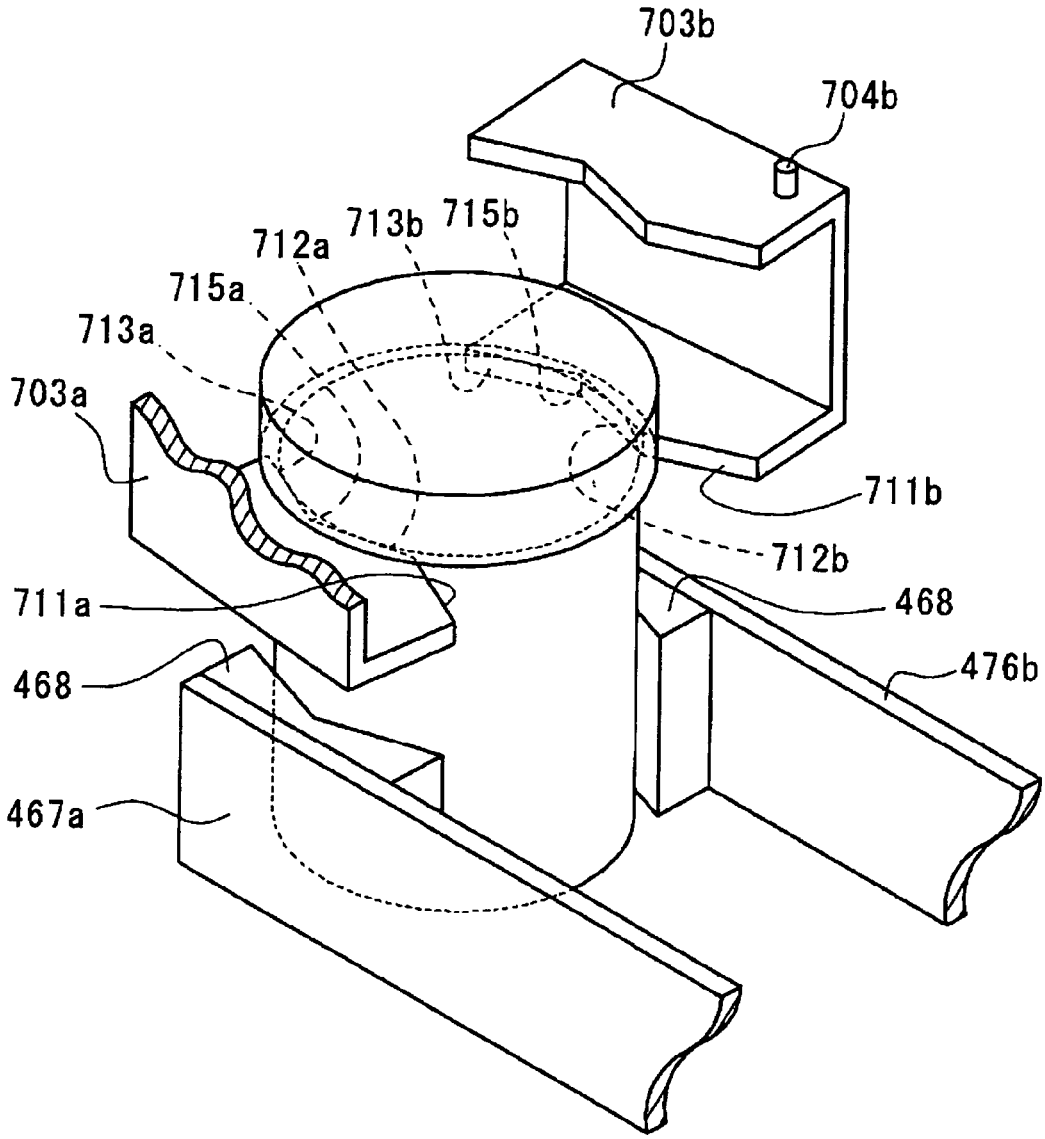
FIG. 10 is a perspective view of the holding members in the storage chamber of FIG. 8.

FIG. 9 shows a plan view of the holding members 703*a*, 703*b*. The plane shape of the holding members 703*a*, 703*b* will be explained in detail. The opposite sides of the symmetrical holding members 703*a*, 703*b* comprise three sides, i.e. from the side provided with the pins 704*a*, 704*b*, first contact sides 711*a*, 711*b*, second contact sides 712*a*, 712*b* and third contact sides 713*a*, 713*b* and also have convex portions 714*a*, 714*b* formed into a crest shape by the first contact sides 711*a*, 711*b* and the second contact sides 712*a*, 712*b*, concave portions 715*a*, 715*b* formed into a valley shape by the second contact sides 712*a*, 712*b* and the third contact sides 713*a*, 713*b* and rear end portions 716*a*, 716*b* which are the other ends of the third contact sides 713*a*, 713*b*. The holding members 703*a*, 703*b* can be pivoted around the pins 704*a*, 704*b* as shown in two-dots chain lines 703*a*', 703*b*' and 703*a*", 703*b*". In FIG. 10, a relation of the heights of the holding members 703*a*, 703*b* for holding the vial 3, the vial 3, and the transfer arms 467*a*, 467*b* of the fourth transfer robot 450 is shown. The holding members 703*a*, 703*b* not only hold the barrel of the vial 3 by means of the concave portions 715*a*, 715*b* but also support the outer edge of the cap 2 of the vial 3 from below. The transfer arms 467*a*, 467*b* grip the lower portion of the barrel of the vial 3.

Figure 11:
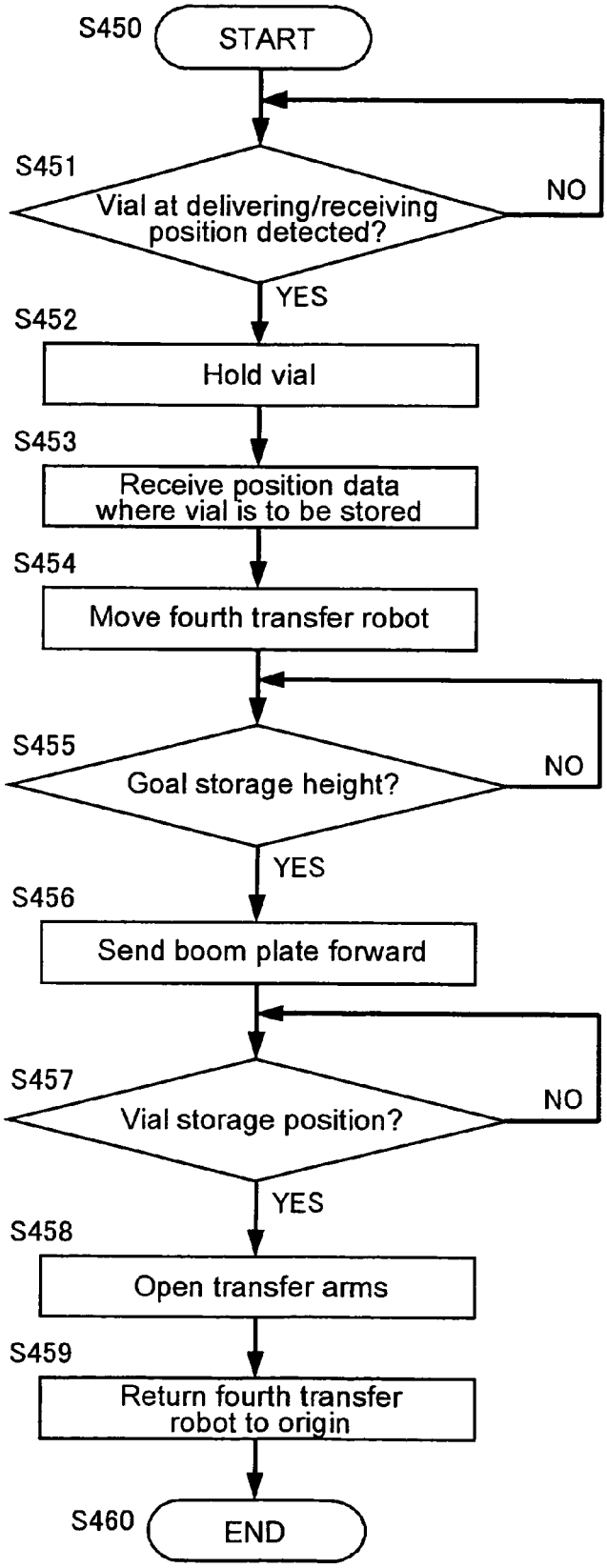
FIG. 11 is a flow chart of control of the fourth transfer robot of FIG. 7.

Operation of the fourth transfer robot 450 will be described with reference to the flowchart of FIG. 11. At step S450, the fourth transfer robot 450 is on standby at a delivering/receiving position as shown by two-dot chain line in the lower part of FIG. 8. When the vial 3 transferred by the third transfer robot 350 is detected at step S451, the grip motor 470 is driven to forwardly rotate the drive gear 471, causing the driven gear 469 to be rotated via the intermediate gear 472. Rotation of the driven gear 469 allows the feed screw 465 to be forwardly rotated. Then, the nuts 466*a*, 466*b* move toward the inside along the guide shaft 464, allowing the grip rubbers 468 of the distal end of the transfer arms 467*a*, 467*b* fixed on the nuts 466*a*, 466*b* to grip the barrel of the vial 3 from both sides. At step S453, receiving position data where the vial 3 is to be stored, the drive motor 456 is driven to rotate the pulley 457 and move the timing belt 455 at step S454, allowing the base plate 454 to ascend along the slide shafts 452. The drive motor 456 is a servo motor and controls the rotation angle from the delivering/receiving position as an origin to stop the base plate 454 at a predetermined height corresponding to the data received at step S453. At step S455, confirming the feedback signal of the servo motor, the drive motor 462 is forwardly rotated at step S456 to rotate the pinion 463, causing the rack 461 to be sent forth. As the boom plate 460 is suspended from the rail 458 by a carriage 459, the boom plate 460 is horizontally sent forward along the rail 458 toward the storage part 700. At step S457, when a sensor corresponding to the data received at step S453 among a plurality of sensors (not shown) provided on the base plate 454 for detecting the position of the boom plate 460 detects that the boom plate 460 has reached the predetermined position, the transfer arms 467*a*, 467*b* are protruded so that the vial 3 can reach any one of the first, second and third holding portions 702*a*, 702*b*, 702*c*. The drive motor 462 is stopped. Then, at step S458, the grip motor 470 is reverse rotated to open the transfer arms 467*a*, 467*b* and release the vial 3, allowing the vial 3 to be held by the holding members 703*a*, 703*h*. Subsequently, at step S459, the drive motor 462 is reverse rotated to retreat the transfer arms 457*a*, 467*b* and the drive motor 456 reverts to the origin so that the fourth transfer robot 450 is returned to the original delivering/receiving position. Thus, at step S460, the transfer operation of the vial 3 is completed.

If a plural kinds of tablets is prescribed and two or three vials 3 need to be taken out by the operator, the storage positions received at step S453 are determined so that two or three vials 3 can be held by two or three of the plurality of holding portions 702*a*, 702*b*, 702*c* provided in any of the storage chambers 701*a*, 701*b*, 701*c*. In this case, if the vial 3 is held by the holding member 702*c* first, then the vial 3 can not be transferred to the holding portions 702*a* and 702*b*. Thus, the vial 3 is designed to be firstly held by the holding portion 702*a* farthest from the fourth transfer robot 450, secondarily by the holding portion 702*b*, and lastly by the holding portion 702*c*. If the vial 3 is held by the holding portion 702*b* when the operator takes out the vial 3 which was held first by the holding portion 702*a*, the next vial 3 is designed to be held by the holding member 702*c*. In the case that the tablets are continuously taken out in accordance with a plurality of prescription data to a plurality of patients, the vials 3 for the plurality of patients are not stored together in one of the storage chambers 701*a*, 701*b*, 701*c* but are distinctively stored in a different one of the storage chambers 701*a*, 701*b*, 701*c*.

As the positions to be stored are determined as described above, even if there is a patient to which a plural kinds of tablets is prescribed, nether forgetting nor mistake will be caused.

Subsequently, operation of the holding member 703*a*, 703*b* of the storage part 700 will be explained. As shown by an arrow in FIG. 9, the vial 3 is inserted between the holding members 703*a*, 703*b* from the side of pins 704*a*, 704*b*. At first, the barrel of the vial 3 comes into contact with the first contact sides 711*a*, 711*b*. When the vial 3 reaches the convex portions 714*a*, 714*h*, the holding members 703*a*, 703*b* are opened to 703*a*", 703*b*". When the vial 3 is further push as the vial comes into contact with the second contact sides 712*a*, 712*b*, the holding members 703*a*, 703*b* are closed due to an urging force of the spring 708. When the vial 3 reaches the space between the concave portions 715*a*, 715*b*, the vial 3 is pinched and supported by four points, i.e. the second contact side 712*a* and the third contact side 713*a* of the holding member 703*a* and the second contact side 712*b* and the third contact side 713*b* of the holding member 703*b*. At this time, the holding members 703*a*, 703*b* are opened to the degree shown by 703*a*', 703*b*'. When the vial 3 is further advanced, the vial 3 pushes the third contact sides 713*a*, 713*b* to open the holding members 703*a*, 703*b* again. When the vial 3 passes the rear ends portions 716*a*, 716*b*, the vial 3 is released from restraint of the holding members 703*a*, 703*b*.

At the time when the vial 3 is pushed between the holding members 703*a*, 703*b*, the direction connecting the points that the vial 3 comes into contact with the holding members 703*a*, 703*b* first with the pins 704*a*, 704*b* is substantially perpendicular to the direction that the vial 3 proceeds. So, it is easy to pivot the holding members 703*a*, 703*b* around the pins 704*a*, 704*b* to open them against the urging force of the spring 708, enabling the vial 3 to be pushed between the holding members 703*a*, 703*b* with a light force. Similarly, when the operator removes the vial 3, it is possible to easily open the holding members 703*a*, 703*b* with a light force to take-out the vial 3. In the process of pushing the vial 3, the holding members 703*a*, 703*b* have an angle as shown by 703*a*', 703*b*', i.e. a minimum open degree in a state in which the vial 3 is gripped between the concave portions 715*a*, 715*b*. That is to say, in order to move the vial 3 in either direction from this state, it is necessary to open the holding members 703*a*, 703*b* against the urging force of the spring 708. This means that the vial 3 is stably held so as not to move. Moreover, as shown in FIG. 10, the holding members 703*a*, 703*b* support the outer edge of the cap 2 from the bottom, thereby preventing the vial 3 from slipping off.

In addition, as shown in FIG. 8, the stock sensor 710 is operable to detect that the spring metal piece 707*a* fixed on the holding member 703*a* is closest with the opposed spring metal piece 707*b*. When the vial 3 is held by the holding members 703*a*, 703*b*, the holding members 703*a*, 703*b* are open as shown by 703*a*', 703*b*'. So, the spring metal piece 707*a* comes away from the stock sensor 710, preventing the stock sensor 710 from detecting the spring metal piece 707*a*. Thus, it is possible to indirectly detect that the vial 3 is held between holding members 703*a*, 703*b*. If the stock sensor 710 can not detect it due to failure in spite of the fact that the vial 3 is held, another vial 3 is transferred between the same holding members 703*a*, 703 by the fourth transfer robot 450, causing a problem because the other vial 3 interferes with the vial 3 that was previously held. In the present embodiment, if the stock sensor 710 is in failure, the stock sensor 710 can not detect the spring metal piece 707*a*. Therefore, it is recognized that the vial 3 is held between the holding members 703*a*, 703*b* in spite of the fact that the vial is not held. Thus, there is no trouble that the fourth transfer robot 450 transfers new vial 3 to the holding portions 702*a*, 702*b*, 702*c* which have already held the vial 3.

The invention claimed is:

1. A tablet storage and take-out apparatus comprising:

a storage part including at least one storage chamber in which a vial filled with tablets is held prior to being taken out, the storage chamber defining a waiting space having an inserting opening and a taking-out opening;

plural pairs of holding members for holding a barrel of the vial, each of the plural pairs of holding members being provided at the waiting space so that the holding members of each pair of holding members are opposed to each other;

the plural pairs of holding members being disposed between the inserting opening and the taking-out opening of the waiting space so as to hold the vial inserted into the inserting opening and removed from the taking-out opening; and stock sensors for detecting whether the vial is held by the plural pairs of holding members or not, the stock sensors being provided so as to correspond to the plural pairs of holding members, respectively.

2. The tablet storage and take-out apparatus as in claim 1, wherein:

the plural pairs of holding members are provided with concave portions that are opposed to each other;

the plural pairs of holding members are supported so as to pivot around two shafts that are spaced away from each other by a distance larger than a diameter of the vial so that the concave portions can come close to and move away from each other;

the plural pairs of holding members are urged so that the concave portions can come close to each other; and the concave portions can pinch and hold a barrel of the vial so that a center of the vial is positioned between the concave portions.

3. The tablet storage and take-out apparatus as in claim 1, wherein the stock sensors are sensors for detecting that the holding members of each of the plural pairs of holding members are situated at a position close to or away from each other depending on a relative position of the holding members.

4. The tablet storage and take-out apparatus as in claim 1, wherein the holding members of the plural pairs of holding members positioned at the take-out side have a high priority;

if none of the plural pairs of holding members have held the vial, the pair of holding members having higher priority holds the vial newly filled with tablets; and if any one of the plural pairs of holding members have held the vial, the pair of holding members having a priority that is next lower than the pair of holding members having a priority that is lowest among the pairs of holding members holding the vial holds the subsequent vial.

5. The tablet storage and take-out apparatus as in claim 1, wherein:

the storage part comprises a plurality of storage chambers;

the plural pairs of holding members located in the same waiting space of the plurality of waiting spaces can hold a plurality of vials filled with tablets for one patient; and the plural pairs of holding members in a different one of the plurality of waiting spaces can hold a vial filled with tablets for a different patient.

6. The tablet storage and take-out apparatus as in claim 2, wherein the stock sensors are sensors for detecting that the holding members of each of the plural pairs of holding members are situated at a position close to or away from each other depending on a relative position of the holding members.

7. The tablet storage and take-out apparatus as in claim 2, wherein:

the holding members of the plural pairs of holding members positioned at the take-out side have a high priority;

if none of the plural pairs of holding members have held the vial, the pair of holding members having a higher priority holds the vial newly filled with tablets; and if any one of the plural pairs of holding members have held the vial, the pair of holding members having a priority that is next lower than the pair of holding members having a priority that is lowest among the pairs of holding members holding the vial holds the subsequent vial.

8. The tablet storage and take-out apparatus as in claim 3, wherein:

the holding member of the plural pairs of holding members positioned at the take-out side have a high priority;

if none of the plural pairs of holding members have held the vial, the pair of holding members having a higher priority holds the vial newly filled with tablets; and if any one of the plural pairs of holding members have held the vial, the pair of holding members having a priority that is next lower than the pair of holding members having a priority that is lowest among the pairs of holding members holding the vial holds the subsequent vial.

9. The tablet storage and take-out apparatus as in claim 2, wherein:

the storage part includes a plurality of storage chambers;

the plural pairs of holding members located in the same waiting space of the plurality of waiting spaces can hold a plurality of vials filled with tablets for one patient; and the plural pairs of holding members in a different one of the plurality of waiting spaces can hold a vial filled with tablets for a different patient.

10. The tablet storage and take-out apparatus as in claim 3, wherein:

the storage part includes a plurality of storage chambers;

the plural pairs of holding members located in the same waiting space of the plurality of waiting spaces can hold a plurality of vials filled with tablets for one patient; and the plural pairs of holding members in a different one of the plurality of waiting spaces can hold a vial filled with tablets for a different patient.

11. The tablet storage and take-out apparatus as in claim 4, wherein:

the storage part includes a plurality of storage chambers;

the plural pairs of holding members located in the same waiting space of the plurality of waiting spaces can hold a plurality of vials filled with tablets for one patient; and the plural pairs of holding members in a different one of the plurality of waiting spaces can hold a vial filled with tablets for a different patient.

* * * * *